United States Patent [19]

McBride

[11] 4,064,765

[45] Dec. 27, 1977

[54] FLYWHEEL ASSEMBLY RING GEAR GUARD

[75] Inventor: Edward D. McBride, Waukegan, Ill.

[73] Assignee: Outboard Marine Corporation, Waukegan, Ill.

[21] Appl. No.: 733,036

[22] Filed: Oct. 18, 1976

[51] Int. Cl.[2] ..... F02N 11/10; F02N 15/10

[52] U.S. Cl. ..... 74/6; 74/7 R; 74/609; 74/612; 123/179 P

[58] Field of Search ..... 74/6, 7 R, 608, 609, 74/612, 613; 123/179 P, 179 SE, 185 A, 185 B, 185 BA

[56] References Cited

U.S. PATENT DOCUMENTS

| | | | |
|---|---|---|---|
| 2,413,266 | 12/1946 | Tinsler et al. | 74/612 |
| 3,134,376 | 5/1964 | Rice | 123/185 BA |

*Primary Examiner*—Edgar W. Geoghegan
*Attorney, Agent, or Firm*—Michael, Best & Friedrich

[57] ABSTRACT

Disclosed herein is an engine comprising a starter pinion and a flywheel assembly including a generally circular member having a peripheral surface including a radially outwardly extending lip. A ring gear is secured to the peripheral surface and includes teeth adapted for engagement with the starter pinion. The flywheel assembly also includes a flexible annular member secured to the circular member between the lip and the ring gear. The flexible member is located adjacent the ring gear to prevent access to the ring gear teeth by an engine operator, and is displaceable away from the ring gear teeth during engagement of the ring gear teeth with the starter pinion.

24 Claims, 3 Drawing Figures

FLYWHEEL ASSEMBLY RING GEAR GUARD

BACKGROUND OF THE INVENTION

This invention relates generally to guard devices used to prevent access to moving mechanical parts, and more particularly, to guard devices used to prevent access to the ring gear of a flywheel assembly utilized with an internal combustion engine.

Attention is directed to the following United States Patents:

Hamman U.S. Pat. Nos. 3,375,831 issued Apr. 2, 1968
Braun 3,744,468 issued July 10, 1973
Ritter, Jr. 3,912,336 issued Oct. 14, 1975
Tinsler 2,413,266 issued Dec. 24, 1946
Siever 632,430 issued Sept. 5, 1899

SUMMARY OF THE INVENTION

The invention provides a flywheel assembly adapted for use with an engine, the flywheel assembly comprising a ring gear including teeth adapted for engagement with a starter pinion, and a flexible member extending adjacent the ring gear teeth to prevent access to the ring gear teeth by an engine operator.

The invention also provides an engine comprising a starter pinion and a flywheel assembly including a ring gear having teeth adapted for engagement with the starter pinion, and a flexible member extending adjacent the ring gear teeth to prevent access to the ring gear teeth by an engine operator.

In accordance with an embodiment of the invention, there is provided a flywheel assembly wherein the flexible member is displaceable away from the ring gear teeth during engagement of the ring gear teeth with the starter pinion.

Also in accordance with an embodiment of the invention, there is provided a flywheel assembly wherein the ring gear teeth and the starter pinion have parallel axes of rotation.

Also in accordance with an embodiment of the invention, there is provided a flywheel assembly wherein the ring gear teeth include top surfaces, and wherein the flexible member is annular and has an outer rib which at least partially extends over the top surfaces of the ring gear teeth.

Also in accordance with an embodiment of the invention, there is provided a flywheel assembly including a generally circular member having a peripheral surface including a radially outwardly extending lip, wherein the ring gear is secured to the peripheral surface, and wherein the flexible member is annular and is secured between the lip and the ring gear.

Also in accordance with an embodiment of the invention, there is provided a flywheel assembly wherein the ring gear is annular and is pressed onto the circular member peripheral surface and against the flexible member, thereby integrally securing the flexible member to the circular member between the lip and the ring gear.

Also in accordance with an embodiment of the invention, there is provided a flywheel assembly wherein the lip partially defines an annular groove and includes a radially extending outer projection, wherein the flexible member has an inner rib which extends into the annular groove, and wherein the outer projection and the flexible annular member define a groove adapted for receiving an engine starting rope.

One of the principal features of the invention is the provision of a flywheel assembly including a ring gear and a flexible member located adjacent the teeth of the ring gear to prevent access to the teeth by an engine operator.

Another of the principal features of the invention is the provision of an engine comprising a starter pinion and a flywheel assembly including a ring gear having teeth adapted for engagement with the starter pinion, which assembly also includes a flexible member extending adjacent the ring gear teeth to prevent access to the ring gear teeth by an engine operator.

Another of the principal features of the invention is the provision of an integral flywheel assembly including a circular member having a peripheral surface with a radially outwardly extending lip, and an annular flexible member which is held in place between the lip and a ring gear which is pressed onto the peripheral surface, which flexible member prevents access to the ring gear teeth by an engine operator and is displaceable away from the ring gear teeth during engagement of the ring gear teeth with a starter pinion.

Other features and advantages of the embodiments of the invention will become known by reference to the following general description, the claims, and drawings.

THE DRAWINGS

Figure 1:
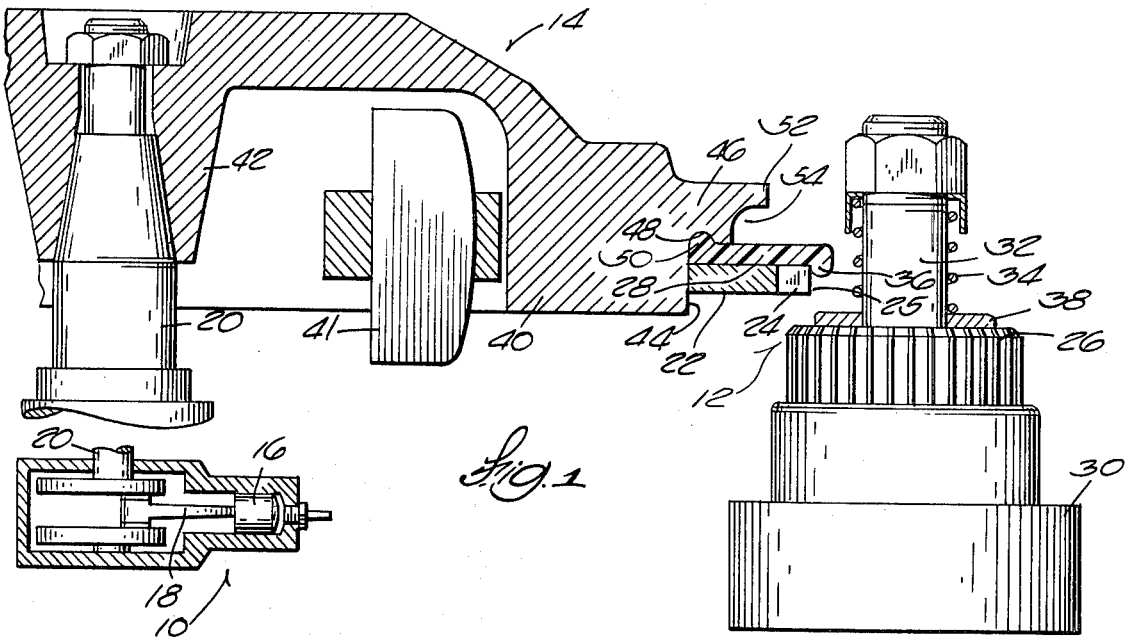
FIG. 1 is a partially schematic sectional view of an engine including a flywheel assembly embodying various features of the invention.

Before explaining the embodiments of the invention in detail, it is to be understood that the invention is not limited in its application to details of construction and the arrangement of components set forth in the following description or illustrated in the drawings. The invention is capable of other embodiments and of being practiced and carried out in various ways. Also it is to be understood that the phraseology and terminology employed herein is for the purpose of description and should not be regarded as limiting.

GENERAL DESCRIPTION

Shown in the drawings is an internal combustion engine 10 which includes a starter assembly 12 and a flywheel assembly 14. The engine 10 conventionally includes a piston 16 having a rod 18 suitably connected to a crank shaft 20 which, in turn, is connected to the flywheel assembly 14.

The flywheel assembly 14 includes a ring gear 22 having teeth 24 which are adapted for engagement with a starter pinion 26 of the starter assembly 12. A flexible member 28 extends adjacent the ring gear 22 to prevent access to the ring gear teeth 24 by an engine operator.

While various arrangements are possible, in the illustrated construction, the ring gear 22 and the starter pinion 26 preferably have parallel axes of rotation. In order to automatically start the engine 10, the starter assembly 12 includes conventional control means (represented diagrammatically as 30) which move the starter pinion 26 axially along a central shaft 32 overcoming a bias spring 34 to effect engagement of the starter pinion 26 with the ring gear teeth 24. The ring gear teeth 24 include outer peripheral or top surfaces 25 which connect the teeth flanks (not shown) which, in turn, engage the teeth of the starter pinion 26 to transmit rotary motion therebetween. Except during starting operation, the bias spring 34 biases the starter pinion 26 to a normal position not in engagement with the ring gear teeth 24.

The flexible member 28 can be comprised of any suitable flexible material such as rubber, and is preferably annular. More specifically, the flexible member 28 preferably comprises are relatively smooth and flat ring-shaped member which includes an inner rib 50 (described below) and a projection or outer rib 36 which at least partially extends over the top surfaces 25 of the ring gear teeth 24. The flexible member 28 prevents access by an engine operator to the ring gear teeth 24 regardless of whether the ring gear teeth 24 are in engagement with the pinion 26 or are stationary or rotating.

Figure 3:
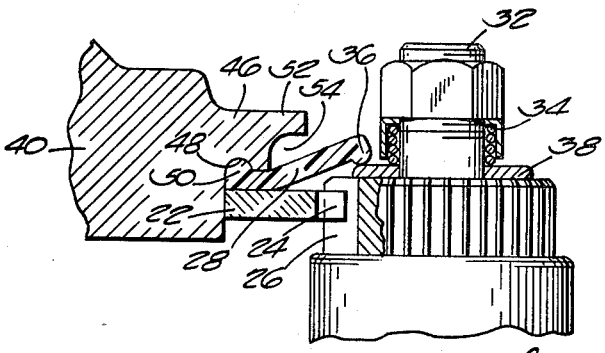
FIG. 3 is a partial view of the engine shown in FIG. 1 illustrating the flexible member in a displaced position.
Figure 2:
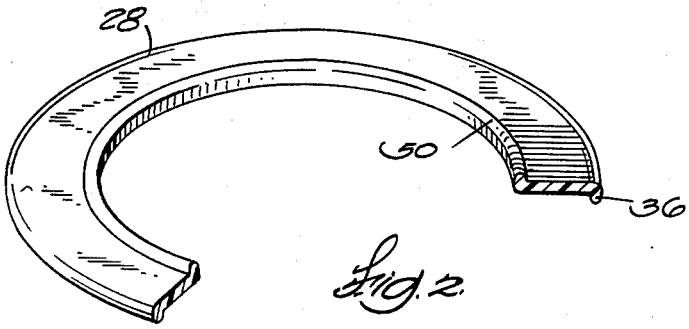
FIG. 2 is an elevational view of an annular flexible member incorporated in the flywheel assembly shown in FIG. 1.

The flexible member 28 is displaceable away from the ring gear teeth 24 during engagement of the ring gear teeth with the starter pinion 26. More specifically, in the illustrated construction shown in FIG. 3, the starter assembly 12 includes a washer 38 held between the bias spring 34 and the upper surface of the starter pinion 26. When the starter pinion 26 is displaced axially along the shaft 32 during an engine starting operation, the washer 38 abuts the member outer rib 36 to displace the flexible member 28 away from the ring gear teeth 24. As illustrated in FIG. 3, the flexible member 28 prevents access to the ring gear teeth 24 by an operator during the automatic engine starting operation.

While various arrangements are possible, as shown in FIG. 1, the flywheel assembly 14 preferably includes a generally circular member 40 including a conventional magneto assembly 41 and having a central portion 42 suitably secured to the crankshaft 20. The circular member 40 has a peripheral surface 44 including a radially outwardly extending lip 46. The annular flexible member 28 is secured between the outwardly extending lip 46 and the ring gear 22 which is suitably secured to the peripheral surface 44.

While various arrangements are possible, as shown in the illustrated construction, the ring gear 22 is annular and is preferably formed separately from the circular member 40. The ring gear 22 is pressed onto the circular member peripheral surface 44 and against the flexible member 28, thereby integrally securing the flexible member 28 to the circular member 40 between the ring gear 22 and the outwardly extending lip 46.

In the illustrated construction, the outwardly extending lip 46 partially defines an inwardly facing annular groove 48, and the annular flexible member 28 includes a projection or inner rib 50 which extends into the annular groove 48. During construction of the flywheel assembly 14, the annular member 28 is positioned on the circular member peripheral surface 44 so that an intermediate portion of the flexible member 28 abuts the lip 46 and so that the inner rib 50 extends into the annular groove 48. The ring gear 22 is then pressed on the circular member peripheral surface 44 against the flexible member 28 so that the inner rib 50 is trapped or held within the annular groove 48 to insure that the flexible member 28 remains in place adjacent the ring gear teeth 24.

The outwardly extending lip 46 preferably includes an outer projection 52, which in combination with the flexible member 28, defines an annular channel or groove 54 adapted for receiving an engine starting rope (not shown). During manual engine starting operation, the flexible member 28 remains in place adjacent the ring gear 22 to prevent access to the ring gear teeth 24 by an operator or by the engine starting rope.

Various of the features of the invention are set forth in the following claims.

What is claimed is:

1. A flywheel assembly adapted for use with an engine, said flywheel assembly comprising a ring gear including teeth adapted for engagement with a starter pinion, and a flexible member extending adjacent said ring gear teeth to prevent access to said ring gear teeth by an engine operator.

2. A flywheel assembly in accordance with claim 1 wherein said flexible member is displaceable away from said ring gear teeth during engagement of said ring gear teeth with the starter pinion.

3. A flywheel assembly in accordance with claim 1 wherein said ring gear teeth and the starter pinion have parallel axes of rotation.

4. A flywheel assembly in accordance with claim 1 wherein said ring gear teeth include top surfaces, and wherein said flexible member is annular and has an outer rib which at least partially extends over said top surfaces of said ring gear teeth.

5. A flywheel assembly in accordance with claim 1 further comprising a generally circular member having a peripheral surface including a radially outwardly extending lip, wherein said ring gear is secured to said peripheral surface, and wherein said flexible member is annular and is secured between said lip and said ring gear.

6. A flywheel assembly in accordance with claim 5 wherein said ring gear is annular and is pressed onto said circular member peripheral surface and against said flexible member, thereby integrally securing said flexible member to said circular member between said lip and said ring gear.

7. A flywheel assembly in accordance with claim 5 wherein said lip partially defines an annular groove and wherein said flexible member has an inner rib which extends into said annular groove.

8. A flywheel assembly in accordance with claim 5 wherein said lip includes a radially extending outer projection, and wherein said outer projection and said flexible annular member define a groove adapted for receiving an engine starting rope.

9. A flywheel assembly adapted for use with an engine, said flywheel assembly comprising a generally circular member having a peripheral surface including a radially outwardly extending lip partially defining an annular groove, a ring gear secured to said peripheral surface, said ring gear including teeth having top surfaces and being adapted for engagement with a starter pinion, and a flexible annular member secured to said circular member between said lip and said ring gear, said flexible annular member having an inner rib which extends into said annular groove, and also having an outer rib which at least partially extends over said top surfaces of said ring gear teeth to prevent access to said ring gear teeth by an engine operator, said flexible member being displaceable away from said ring gear teeth during engagement of said ring gear teeth with the starter pinion.

10. A flywheel assembly in accordance with claim 9 wherein said ring gear teeth and the starter pinion have parallel axes of rotation.

11. A flywheel assembly in accordance with claim 9 wherein said ring gear is annular and is pressed onto said circular member peripheral surface and against said flexible member, thereby integrally securing said flexible member to said circular member between said lip and said ring gear.

12. A flywheel assembly in accordance with claim 9 wherein said lip includes a radially extending outer projection, and wherein said outer projection and said flexible annular member define a groove adapted for receiving an engine starting rope.

13. An engine comprising a starter pinion and a flywheel assembly including a ring gear having teeth adapted for engagement with a starter pinion, and a flexible member extending adjacent said ring gear teeth to prevent access to said ring gear teeth by an engine operator.

14. An engine in accordance with claim 13 wherein said flexible member is displaceable away from said ring gear teeth during engagement of said ring gear teeth with said starter pinion.

15. An engine in accordance with claim 13 wherein said ring gear teeth and said starter pinion have parallel axes of rotation.

16. An engine in accordance with claim 13 wherein said ring gear teeth include top surfaces, and wherein said flexible member is annular and has an outer rib which at least partially extends over said top surfaces of said ring gear teeth.

17. An engine in accordance with claim 13 wherein said flywheel assembly includes a generally circular member having a peripheral surface including a radially outwardly extending lip, wherein said ring gear is secured to said peripheral surface, and wherein said flexible member is annular and is secured between said lip and said ring gear.

18. An engine in accordance with claim 17 wherein said ring gear is annular and is pressed onto said circular member peripheral surface and against said flexible member, thereby integrally securing said flexible member to said circular member between said lip and said ring gear.

19. An engine in accordance with claim 17 wherein said lip partially defines an annular groove and wherein said flexible member has an inner rib which extends into said annular groove.

20. An engine in accordance with claim 17 wherein said lip includes a radially extending outer projection, and wherein said outer projection and said flexible annular member define a groove adapted for receiving an engine starting rope.

21. An engine comprising a starter pinion and a flywheel assembly including a generally circular member having a peripheral surface including a radially outwardly extending lip partially defining an annular groove, a ring gear secured to said peripheral surface, said ring gear including teeth having top surfaces and being adapted for engagement with a starter pinion, and a flexible annular member secured to said circular member between said lip and said ring gear, said flexible annular member having an inner rib which extends into said annular groove, and also having an outer rib which at least partially extends over said top surfaces of said ring gear teeth to prevent access to said ring gear teeth by an engine operator, said flexible member being displaceable away from said ring gear teeth during engagement of said ring gear teeth with said starter pinion.

22. An engine in accordance with claim 21 wherein said ring ear teeth and said starter pinion have parallel axes of rotation.

23. An engine in accordance with claim 21 wherein said ring gear is annular and is pressed onto said circular member peripheral surface and against said flexible member, thereby integrally securing said flexible member to said circular member between said lip and said ring gear.

24. An engine in accordance with claim 21 wherein said lip includes a radially extending outer projection, and wherein said outer projection and said flexible annular member define a groove adapted for receiving an engine starting rope.

* * * * *